US008646163B2

(12) United States Patent
Evans et al.

(10) Patent No.: US 8,646,163 B2
(45) **Date of Patent: *Feb. 11, 2014**

(54) METHOD OF FORMING A GOLF CLUB HEAD WITH IMPROVED AERODYNAMIC CHARACTERISTICS

(75) Inventors: D. Clayton Evans, San Marcos, CA (US); Evan D. Gibbs, Encinitas, CA (US); Matthew T. Cackett, San Diego, CA (US); Steven M. Ehlers, Poway, CA (US)

(73) Assignee: Callaway Golf Company, Carlsbad, CA (US)

( * ) Notice: Subject to any disclaimer, the term of this patent is extended or adjusted under 35 U.S.C. 154(b) by 389 days.

This patent is subject to a terminal disclaimer.

(21) Appl. No.: 13/166,578

(22) Filed: Jun. 22, 2011

(65) Prior Publication Data

US 2011/0247190 A1 Oct. 13, 2011

Related U.S. Application Data

(63) Continuation-in-part of application No. 13/023,233, filed on Feb. 8, 2011, now Pat. No. 8,510,927.

(60) Provisional application No. 61/303,161, filed on Feb. 10, 2010, provisional application No. 61/365,233, filed on Jul. 16, 2010.

(51) Int. Cl.
*B23P 15/00* (2006.01)

(52) U.S. Cl.
USPC ..... 29/407.01

(58) Field of Classification Search
USPC ..... 29/407.01, 407.1, 428; 473/324–350
See application file for complete search history.

(56) References Cited

U.S. PATENT DOCUMENTS

| | | | | |
|---|---|---|---|---|
| 7,163,468 | B2 | 1/2007 | Gibbs et al. | |
| 7,163,470 | B2 | 1/2007 | Galloway et al. | |
| 7,166,038 | B2 | 1/2007 | Williams et al. | |
| 7,214,143 | B2 | 5/2007 | Deshmukh | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,273,419 | B2 | 9/2007 | Evans et al. | |
| 8,510,927 | B2 * | 8/2013 | Evans et al. | 29/407.01 |

* cited by examiner

*Primary Examiner* — John C Hong
(74) *Attorney, Agent, or Firm* — Rebecca Hanovice; Michael A. Catania; Sonia Lari

(57) ABSTRACT

Methods of forming a golf club head having improved aerodynamic characteristics are disclosed herein. A preferred method is the largest tangent circle method, which utilizes a Cartesian coordinate system. The method results in identification of the highest point of the crown surface located within a crown apex zone, and this location aids in the design of improved aerodynamic properties of the golf club head.

6 Claims, 8 Drawing Sheets

METHOD OF FORMING A GOLF CLUB HEAD WITH IMPROVED AERODYNAMIC CHARACTERISTICS

CROSS REFERENCES TO RELATED APPLICATIONS

This application is a continuation-in-part of U.S. patent application Ser. No. 13/023,233, filed on Feb. 8, 2011, which claims priority to U.S. Provisional Patent Application No. 61/303,161, filed on Feb. 10, 2010. This application also claims priority to U.S. Provisional Patent Application No. 61/365,233, filed on Jul. 16, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a method for reducing the effects of drag force when using a driver.

2. Description of the Related Art

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA.

An area of driver performance improvement that exists, as of this date, is the potential to reduce the drag force that opposes the driver's travel through the air during its path to the golf ball on the tee. A reduction in drag force would allow the driver club head to travel faster along its path and contribute to an improved impact event with the golf ball, resulting in higher golf ball velocities and consequentially, in longer golf shots.

The prior art discloses various designs to reduce the drag force to improve driver performance. The prior art fails, however, to provide a driver with designs that efficiently reduce drag forces and consequentially enable the driver to be swung faster along its path and contribute to an improved impact event with the golf ball.

The recent past has shown that driver designs have trended to include characteristics to increase the driver's inertia values to help off-center hits go farther and straighter. Driver designs have also recently included larger faces, which may help the driver deliver better feeling shots as well as shots that have higher ball speeds if hit away from the face center. However, these recent trends may also be detrimental to the driver's performance due to the head speed reductions that these design features introduce due to the larger geometries. The design of the present invention allows for higher inertias and robust face design of current drivers in addition to a driver design that will lower the drag forces on the club head and improve drag coefficients on the face, sole, and crown surfaces.

BRIEF SUMMARY OF THE INVENTION

The purpose of this invention is to effectively incorporate design features in the driver club head that enable lower drag coefficients as the driver is swung by a golfer. The design features reduce drag forces and consequently allow the driver to be swung faster than conventional driver designs that currently exist. By improving the drag coefficients of the crown and sole surfaces and lowering the overall drag forces that impede the driver club head from moving faster through the air, the head speed of the driver increases by approximately 1 to 3 miles per hour.

The present invention achieves lower drag coefficients by improving the aspect ratio of the driver club head and improving the driver club head crown surface design. To improve the aspect ratio of the driver club head, a driver is created that has an increased depth, distance from the face to the most rearward point, while reducing the overall height. This design improves air flow over the face and crown of the driver and minimizes the overall projected area of the club head in the direction of the air flow. Improvements to the driver club head crown surface design include creating a driver having a crown surface that is flatter, with less curvature, while combining it with an apex point location that is further away from the face to promote a more preferred air flow over the club head.

The objective of the present invention is accomplished by using the Largest Tangent Circle Method. The method for forming a driver type golf club head comprises placing the club head into a Cartesian Coordinate System (CCS) comprising an X axis, a Y axis, and a Z axis, wherein three perpendicular planes exist. The three perpendicular planes are XY, YZ and XZ, and the three perpendicular planes intersect at an origin point. The club head comprises a body, a hosel, a crown, a sole and a face. The driver club head is oriented on the CCS in such a manner that the hosel axis line of the club head lies in the YZ plane, which passes through the origin point. The club head is further oriented such that the hosel axis line of the club head lies at a 60 degree angle measured from the −Y axis. The club head is further oriented by pivoting the club head around the hosel axis line until two points, a toe point and a heel point, approximately 1 inch on either side of the face center point, have the same distance to the YZ plane.

When the club is positioned as described, it is in the proper position to obtain the preferred cross-sectional orientation through the club head. The 3D silhouette curves of the crown and sole surfaces of the club head, as viewed along the +X axis, are projected onto a measurement plane parallel to the YZ plane along a vector parallel to the X axis, thus creating 2D curves on the measurement plane. A circle is then placed on the measurement plane between the projected 2D crown and sole curves and is enlarged until the circle becomes tangent to the projected 2D crown curve and tangent to the projected 2D sole curve, having the maximum diameter possible, rounding to the nearest 0.001 inch. A line is then created from a tangent point where the circle touches the projected 2D crown silhouette curve to a tangent point where the circle touches the projected 2D sole silhouette. The line created between the two tangent points is projected parallel along the X axis, creating a plane to derive the 2D intersection curves of the club head. These 2D intersection curves represent the outline of the club head in the proper orientation for analyzing the relationships between the face, crown, and sole surfaces.

After orienting the club head as described and deriving the ideal cross-section, a rectangle is positioned approximately 0.030 inch above, in the +Z direction and 0.800 inch to the right, in the +X direction, of a endpoint of an intersection of the face and the crown. The rectangle preferably has a height of 0.25 inch and a preferred length of 1.00 inch, the rectangle defining a crown apex zone, wherein the highest point of the crown surface is located within the crown apex zone.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention relates to design relationships and methods of measurement to achieve an improved aspect ratio of a golf club driver head 20 and an improved golf club driver head 20 crown 26 surface design. The "Largest Tangent Circle Method" (LTCM) was developed to verify the existence of conforming and non-conforming geometries of driver club heads 20.

Figure 1:
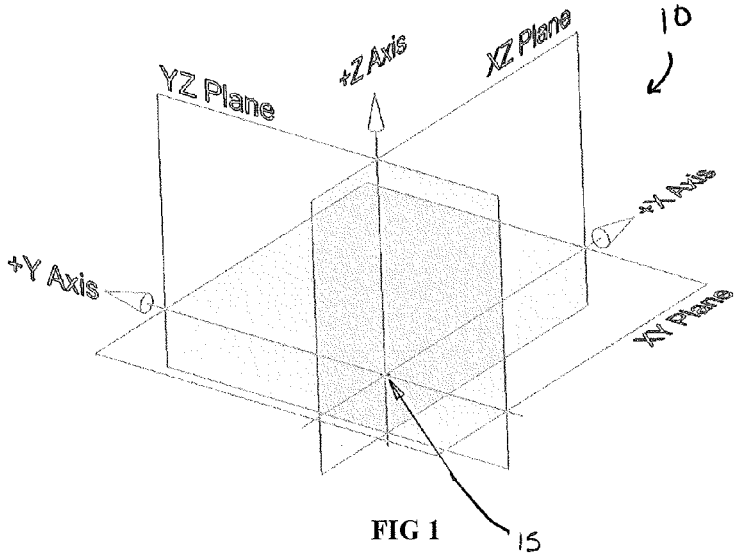
FIG. 1 is a perspective view of a Cartesian coordinate system.

In a preferred embodiment of the present invention, the method for forming and/or measuring a driver type golf club head 20 comprises placing the club head 20 into a Cartesian Coordinate System (CCS) 10 comprising an X axis, a Y axis, and a Z axis, all of which intersect at an origin point. Three perpendicular planes, XY, YZ and XZ, exist within the CCS and also intersect at the origin point 15, as shown in FIG. 1. The resulting lines of intersection of the three planes with each other are perpendicular lines representing the CCS, with each line or axis being labeled appropriately X, Y, and Z and passing through the origin point 15. The values on either side of the origin 15 of the X, Y, and Z axis are labeled either positive or negative, as defined and understood in the CCS.

Figure 2:
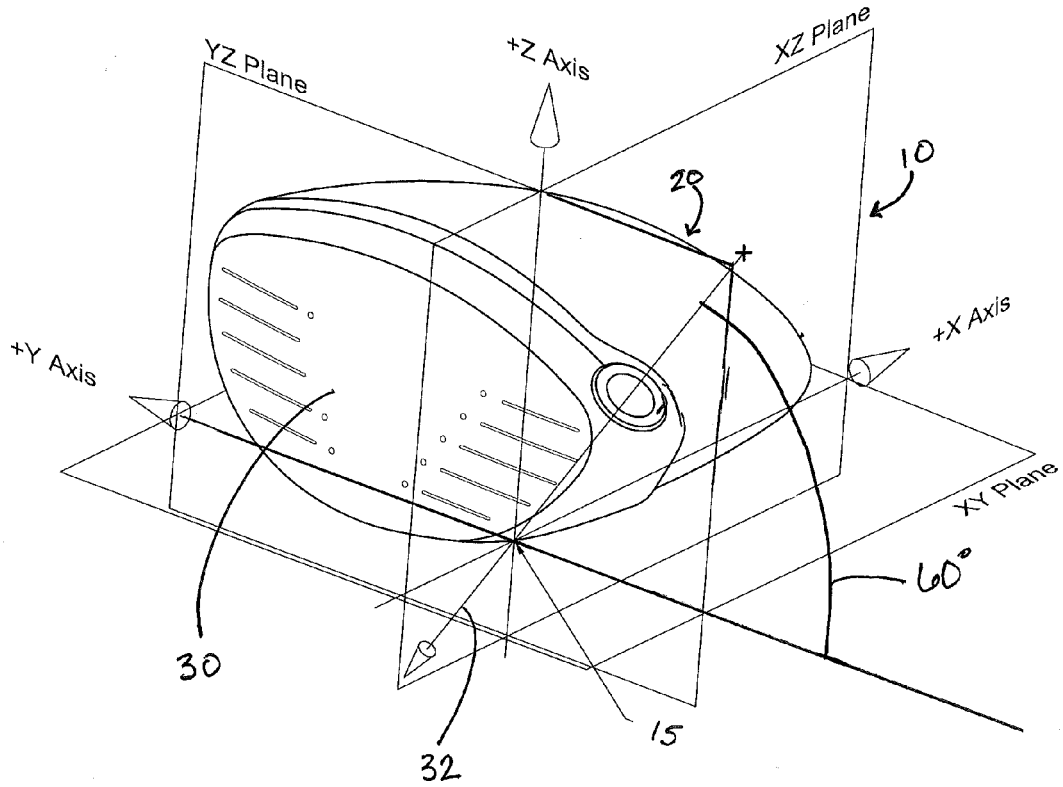
FIG. 2 is a front, perspective view of a golf club head superimposed on a Cartesian coordinate system according to a method of the present invention.

In the preferred embodiment, the club head 20 placed within the CCS comprises a hosel 24, a crown 26, a sole 25 and a face 30, as shown in FIG. 2. Preferably, the driver type golf club head 20 placed within the CCS has a volume of less than 500 cubic centimeters. Preferably, the sole 25 is composed of a metal material and the crown 26 is composed of a nonmetal material. The body of the golf club head 20 preferably is composed of a titanium alloy material. In the inventive method, the hosel axis line 32 of the club head 20 is oriented in the YZ plane such that it passes through the origin point 15. The club head 20 is further oriented with the hosel axis line 32 lies at a 60 degree angle measured from the −Y axis.

Figure 6:
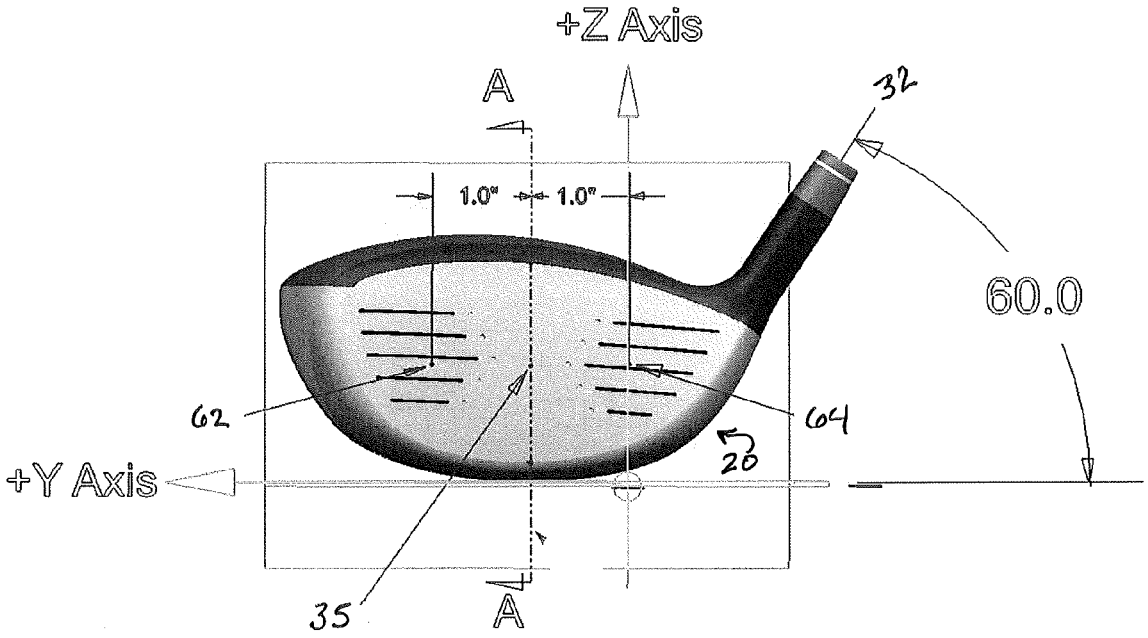
FIG. 6 is a front plan view of a golf club head with locating marks
Figure 7:
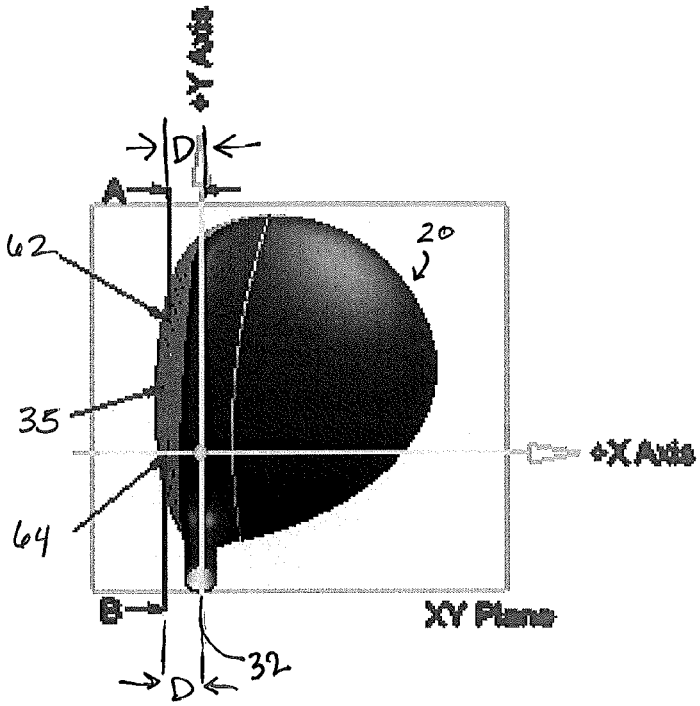
FIG. 7 is a top, plan view of the golf club head shown in FIG. 6.

Once the club head 20 is oriented as described above, it is further adjusted by rotating the club head 20 around the hosel axis line 32 until two points, a toe point 62 and a heel point 64, each of which are approximately one inch on either side of the face center point 35, have the same distance D to the YZ plane, as shown in FIGS. 6 and 7.

Figure 3A:
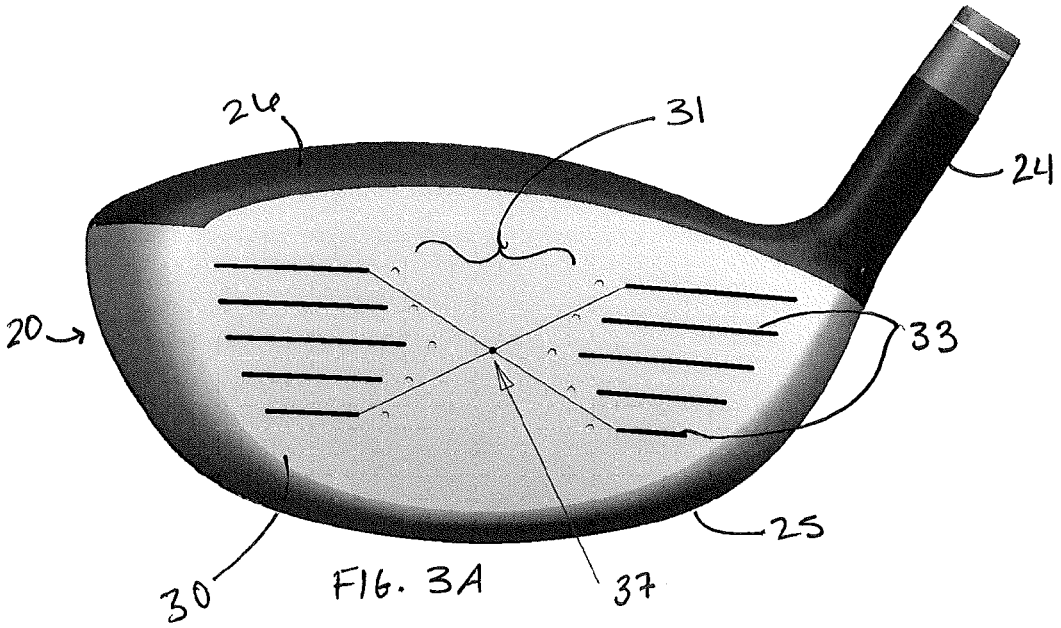
FIGS. 3A and 3B are front, plan views of a golf club head with face center locating marks superimposed thereon.
Figure 3B:
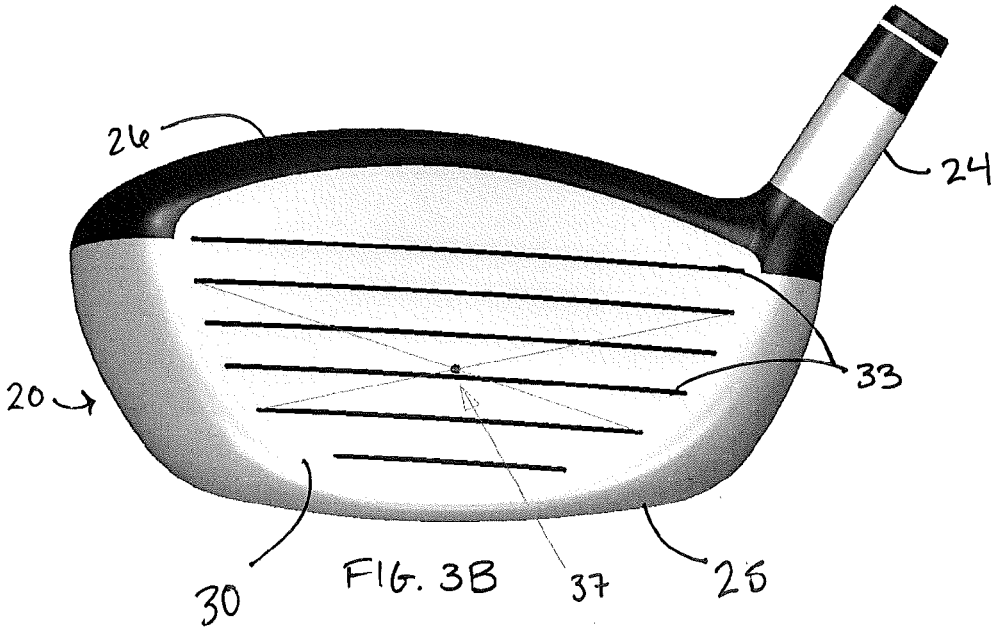

The horizontal face center point 37 can be located as shown in FIGS. 3A and 3B. If the golf club face 30 has scorelines 33 with a blank space 31 in the middle, as shown in FIG. 3A, diagonal lines are drawn from the central ends of the upper scorelines 33 to the central ends of the lower scorelines 33 across the blank space 31 to locate the horizontal center point 37. If the golf club face 30 has scorelines 33 stretching across the face 30, diagonal lines are drawn from the ends of the second scoreline 33 from the top to the ends of the second scoreline 33 from the bottom, as shown in FIG. 3B. In both FIGS. 3A and 3B, the horizontal center point 37 is located where the diagonal lines intersect.

Figure 4:
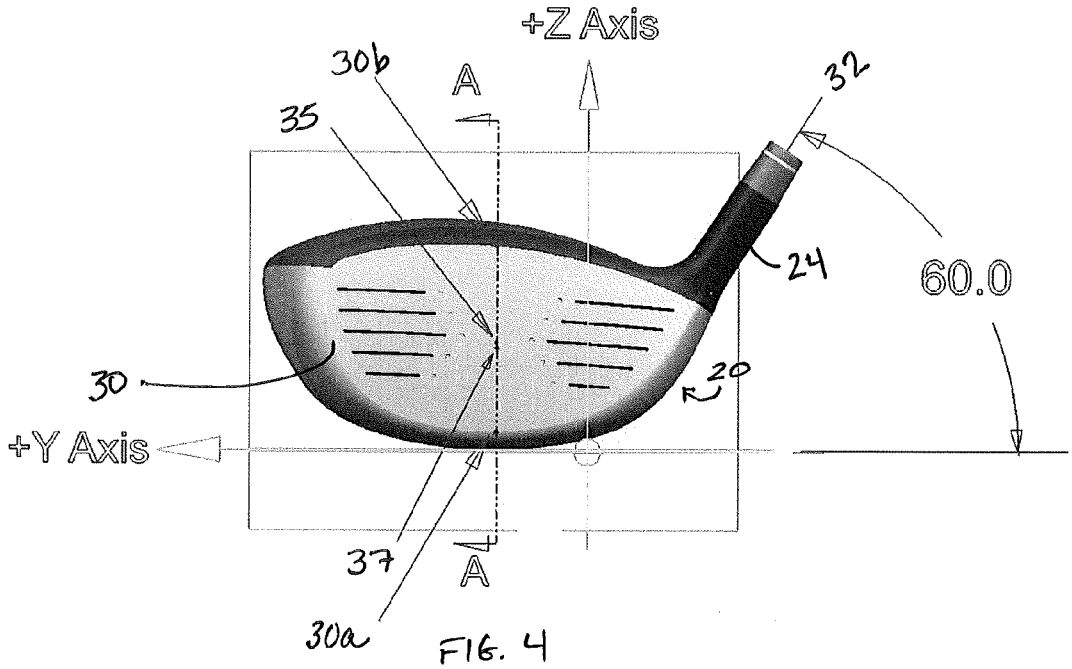
FIG. 4 is a front, plan view of a golf club head with face center locating marks.
Figure 5:
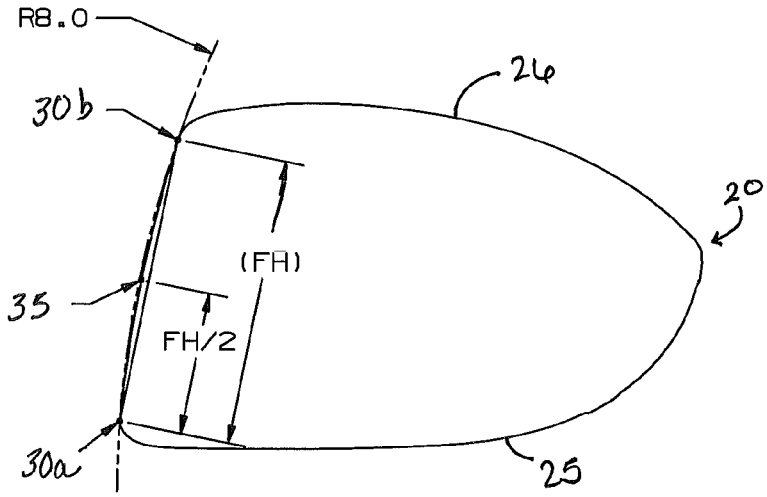
FIG. 5 is a cross sectional view of the golf club head shown in FIG. 4 along lines A-A, through the horizontal face center parallel to the XZ plane.

The face center point 35 is shown in FIGS. 4 and 5, which illustrate how to define the face center point 35 in relation to the bottom 30*a* and top 30*b* of the club face 30. As shown in these Figures, the golf club head 20 is sectioned along lines A-A parallel to the Z axis through the horizontal face center point 37 measured along the Y axis, and the height FH of the face 30 is measured and divided in half to arrive at the location of the center of the face 35.

Figure 8:
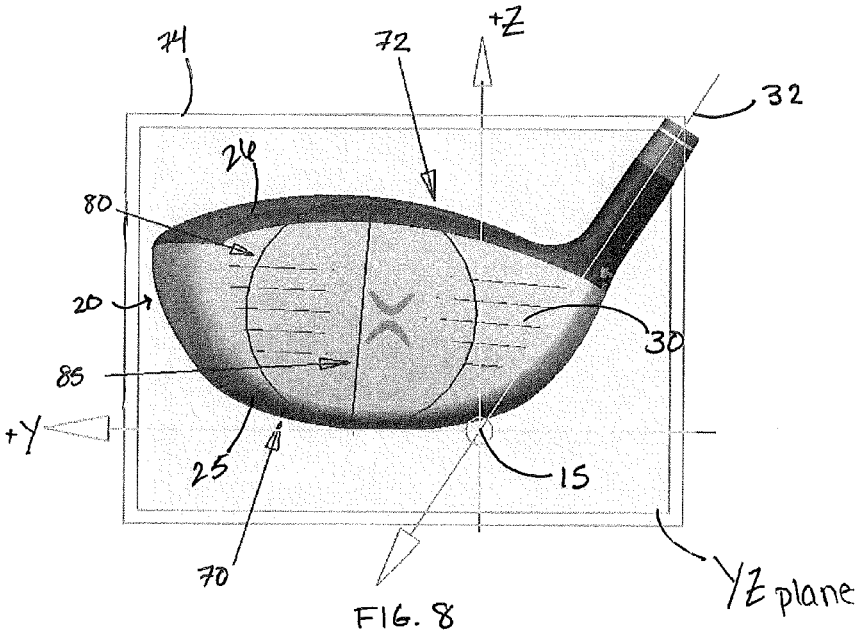
FIG. 8 is a front, plan view of the golf club head shown in FIG. 6.
Figure 9:
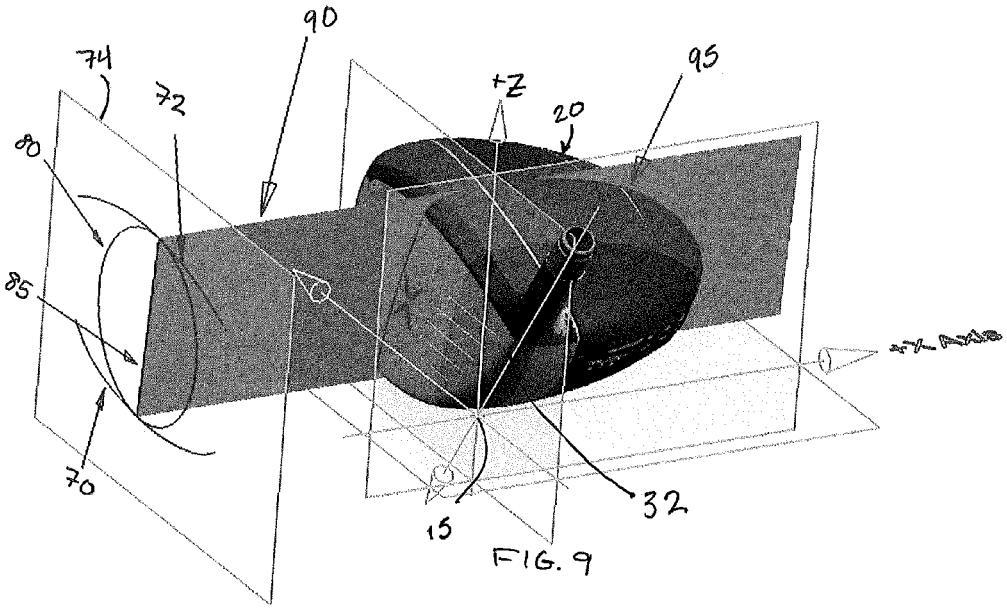
FIG. 9 is a side, perspective view of the golf club head shown in FIG. 8 with projected dimensions.

Once the club head 20 is oriented as described above, it is in the proper position to derive the preferred cross-sectional orientation for measurement and analysis. As shown in FIGS. 8 and 9, 3D silhouette curves of the sole 25 and crown 26 surfaces are projected onto a measurement plane 74, parallel to the YZ plane, along a vector parallel to the X axis, creating 2D curves 70, 72 on the measurement plane. A circle 80 is then placed on the measurement plane 74 between the projected 2D sole curve 70 and crown curve 72 and enlarged until it has the maximum diameter possible, preferably rounded to the nearest 0.001 inch, and is tangent to both projected curves 70, 72. A line 85 is then drawn from the tangent point where the circle 80 touches the projected crown silhouette curve 72 to the tangent point where the circle 80 touches the projected sole silhouette curve 70.

As shown in FIG. 9, the line 85 created between the tangent points is projected parallel along the X axis, thus creating a plane 90 to derive 2D intersection curves 95 of the club head 20. These 2D intersection curves represent the outline or cross-section 95 of the club head 20 in the proper orientation for analyzing relationships between the face 30, crown 26, and sole 25 surfaces.

Figure 10:
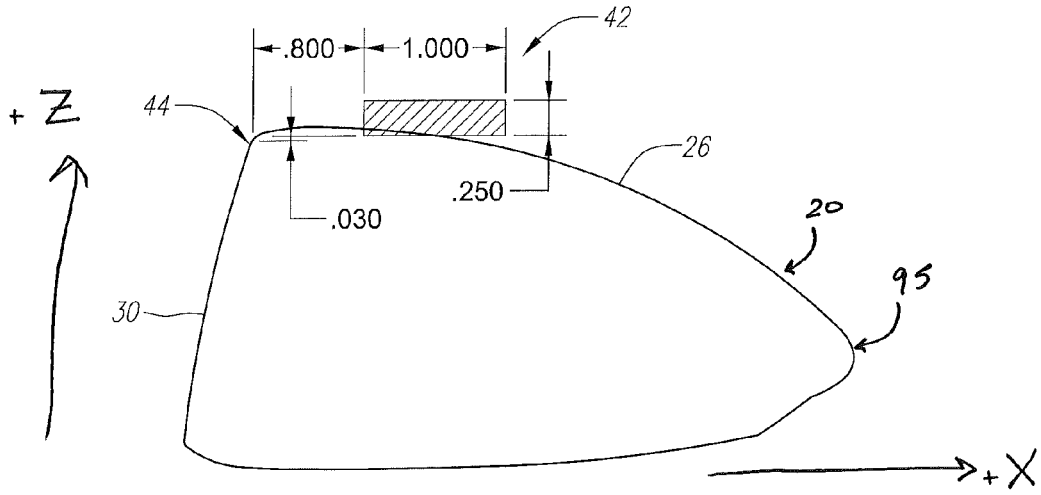
FIG. 10 is a cross sectional view showing the endpoint of intersection of a golf club head.

Referring to the cross-section 95 derived according to the LTCM described above and in FIGS. 1-9, the present invention also provides methods of improving the aspect ratio of a driver club head and improving the crown surface design of a driver club head. These methods relate to the location of a crown apex zone 42, which is shown in FIG. 10. In order to locate the crown apex zone 42, a rectangle is positioned on the cross-section 95 of the golf club head 20 approximately 0.030 inch above (in the +Z direction) and 0.800 inch to the right (in the +X direction) of an endpoint of an intersection 44 of the uppermost point of the face 30 with the plane 90. The rectangle 42 preferably has a height of 0.25 inch and a preferred length of 1.00 inch, and defines the crown apex zone 42, wherein the highest point of the crown 26 surface is located within the crown apex zone 42.

Figure 11:
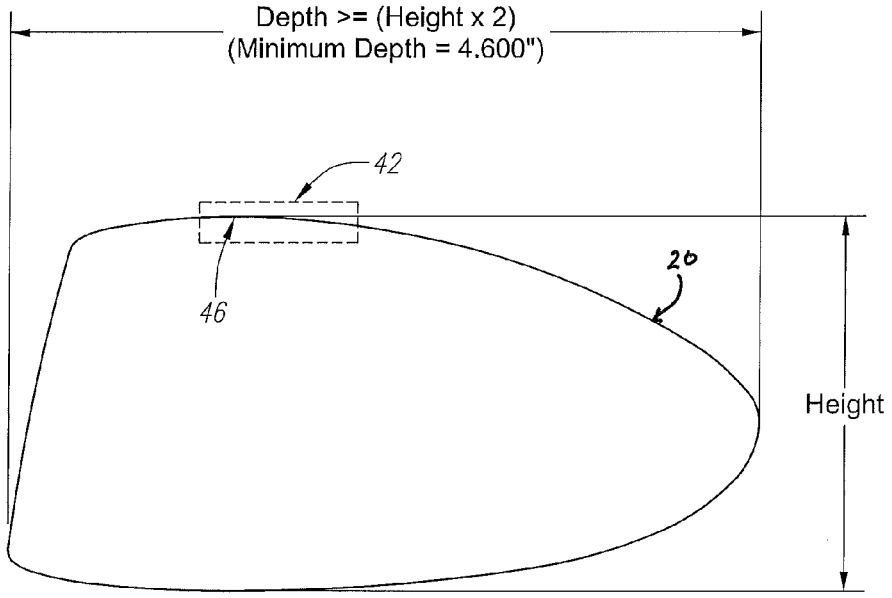
FIG. 11 is a cross sectional view showing the crown apex zone of a golf club head.

According to the present invention, the highest point of the crown 26 surface of the golf club head 20, or the apex point 46, should be located within the crown apex zone 42 as shown in FIG. 11. The crown apex zone 42 preferably is further away from the face 30 of the golf club head 20, in the +X direction, and relatively not too high above the upper edge of the face 30, in the +Z direction. When the apex 46 of the crown 26 surface falls within this zone, the airflow moving across the crown 26 surface of the golf club head 20 remains attached to the club head 20 and reduces the drag of the driver type golf club head 20.

In addition to the design of the crown 26 surface with respect to the crown apex zone 42 and the crown apex point 46, the flatness of the crown 26 contour and the depth of the golf club head 20 aid in reducing the drag of the club head 20. Computational Fluid Dynamic (CFD) studies show that the flatter the crown 26 portion of the club head 20, the longer the airflow across the crown 26 stays attached to the crown 26 without becoming turbulent and then separating. Furthermore, the longer the air can travel along the crown 26 before separating, lower drag forces are promoted.

The methods of the present invention are used to improve aerodynamic properties of a driver golf club head 20 and involve the relationship that the apex point 46 on the crown 26 surface of a club head 20 has with other geometric features on the club head 20, such as its depth, height and curvature of the crown 26 surface. The present invention comprises two methods of enhancing the swing characteristics of a driver club head 20 by reducing the drag force. Driver type golf club heads 20 created using the methods disclosed herein enable the golfer to benefit from an improved driver 20 design more suited to hitting shots with higher ball velocities due to the increased head speed produced by lower drag forces opposing the driver 20 as it travels through the air.

Method #1). Improved Aspect Ratio of Driver Club Head.

One method of the present invention involves creating a driver type golf club head 20 that has an increased depth, or distance from the face 30 to the most rearward point along the X axis, while reducing its height along the Z axis. This improves air flow over the face 30 and crown 26 of the driver type golf club head 20, which minimizes the overall projected area of the club head 20 in the direction of the airflow.

In conjunction with reducing the drag coefficient of the crown 26 surface, the projected area of the golf club head 20 is also reduced. The projected area is a variable in the drag equation, and the lower the area, the better opportunity exists to lower the overall drag of the club head 20. By using a club height, h, that is less than half the depth, d, of the club head 20, a projected area shape that is lower in overall area and shallower in aspect ratio is achieved in comparison to projected area shapes of drivers with deeper club heights. For example if an air molecule hits the center of a driver club 20 face 30, the distance it has to travel up the face 30 and around the club head 20 is less if the face 30 height is shallower versus the distance it must travel on deeper face 30 driver 20.

As shown in FIG. 11, the apex point 46 of the crown 26 is located in the rectangular zone, or crown apex zone 42, and the depth, d, of the club head 20 is at least twice the length as the height, h, of the club head 20 as measured in the plane 95 defined by the LTCM method. The minimum depth, d, of the club head 20 is greater than or equal to 4.600 inches.

Method #2). Improved Driver Club Head Crown Surface Design.

An alternative method of the present invention involves creating a driver type golf club head 20 having a crown 26 surface that is flatter, combined with an apex point 46 location that is further away from the face 30 to promote a more preferred air flow over the club head 20.

The feature of a flatter crown 26 surface reduces the drag of the air flow over the crown 26 in a favorable manner if the apex point 46 of the crown 26 is within the crown apex zone 42 and the crown 26 surface does not drop off too rapidly. When the apex point 46 is positioned in the crown apex zone 42, and a flatter crown 26 curvature continues rearward along the +X axis, the club 20 creates lower drag forces. In addition, the longer the air flow can stay attached to the surface of the crown 26, without becoming separated, the lower the drag forces that are generated. Thus, club head 20 depths greater than 4.600 inches are preferred.

Figure 12:
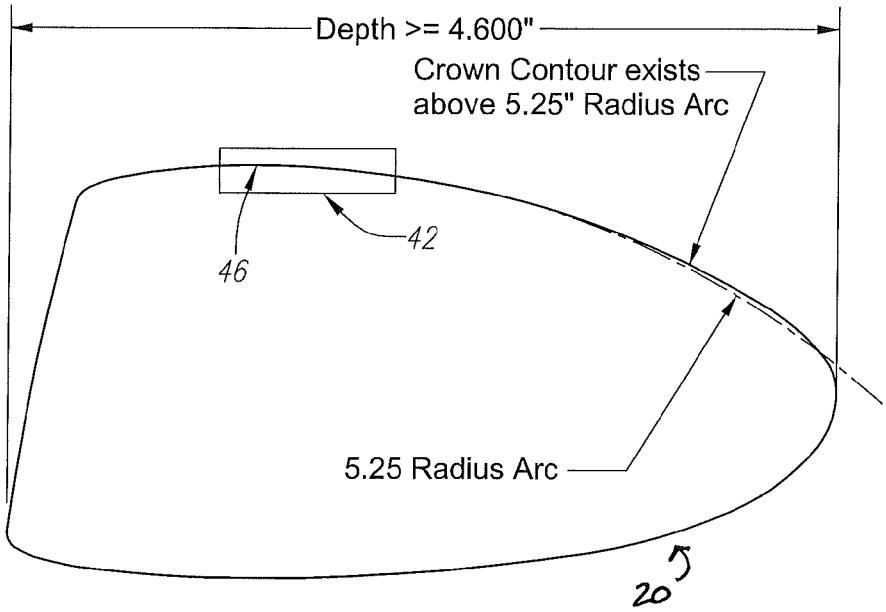
FIG. 12 is a cross sectional view showing a radius arc above 5.25 inches of a golf club head.

As shown in FIG. 12, using the cross-section 95 of a driver club head 20 derived using the LTCM method with apex 46 of the crown located within the crown apex zone 42, the crown 26 curve is designed to have some portion exist above a 5.25 inch radius arc that begins at the apex point 46 of the crown 26 curve and runs towards the back end of the club head 20, in the +X direction.

Figure 13:
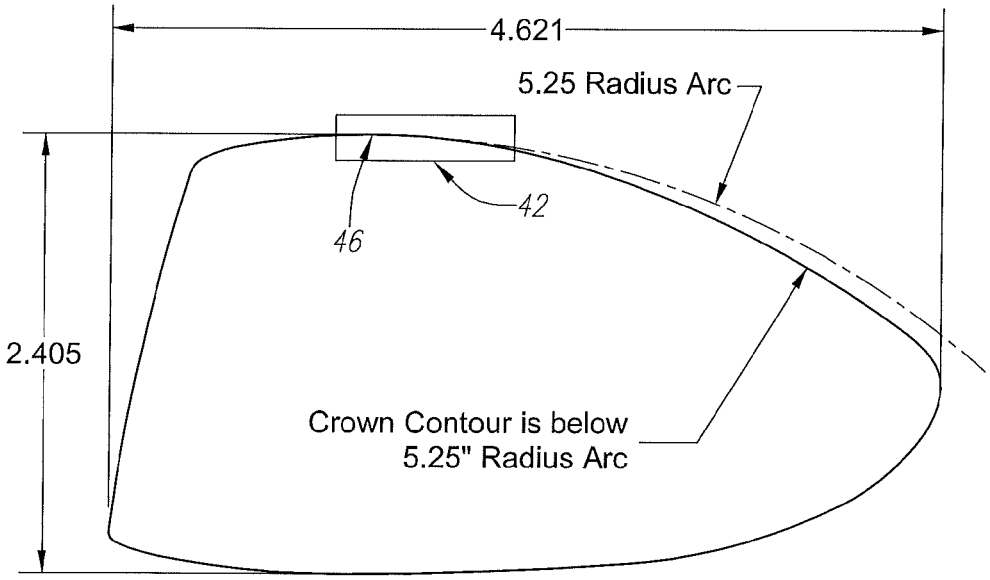
FIG. 13 (Prior Art)
FIG. 13 is a cross sectional view of a golf club in the prior art.
Figure 14:
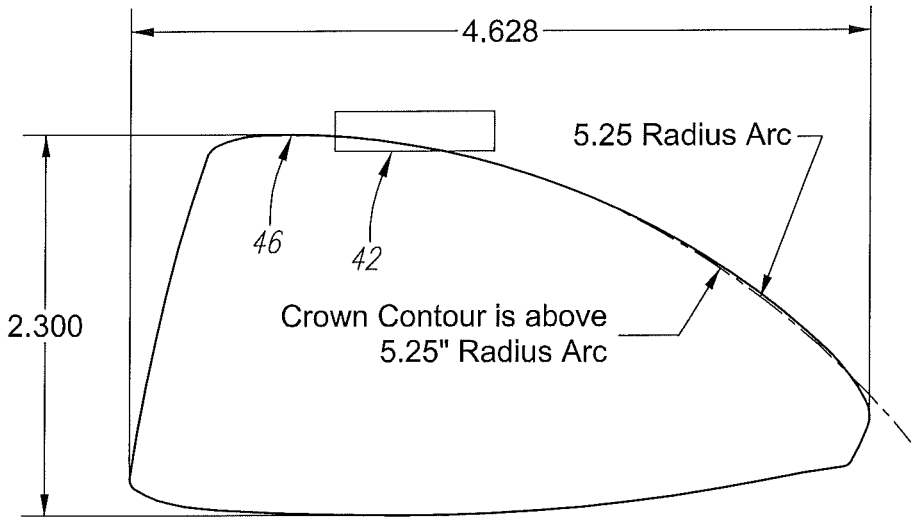
FIG. 14 (Prior Art)
FIG. 14 is a cross sectional view of an alternative golf club in the prior art.
Figure 15:
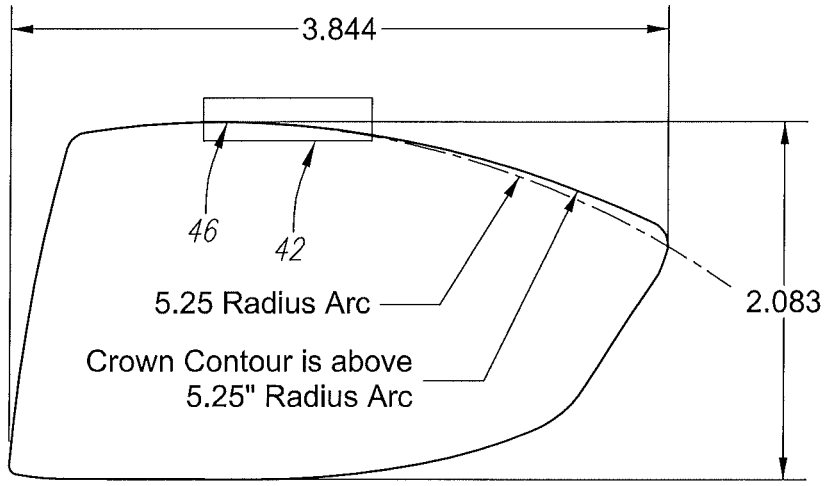
FIG. 15 (Prior Art)
FIG. 15 is a cross sectional view of a second alternative golf club in the prior art.

For comparison purposes, FIG. 13-15 show golf club heads in the prior art, wherein the design features do not comply with the parameters set forth in the methods of the present invention. In FIG. 13, the apex of the crown is located within the desired crown apex zone 42 but the height is more than 50% of the depth. FIG. 14 shows a golf club head of the prior art wherein the apex point 46 of the crown does not lie within the crown apex zone 42. And lastly, FIG. 15 shows an alternative golf club in the prior art wherein the depth of the club is not equal to or greater than 4.600 inches.

The golf club head 20 of the present invention may be made of one or more materials, may include variable face thickness technology, and may have one or more of the structural features described in U.S. Pat. No. 7,163,468, U.S. Pat. No. 7,163,470, U.S. Pat. No. 7,166,038, U.S. Pat. No. 7,214,143, U.S. Pat. No. 7,252,600, U.S. Pat. No. 7,258,626, U.S. Pat. No. 7,258,631, U.S. Pat. No. 7,273,419, each of which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A method for designing a driver type golf club head, the method comprising:

placing a club head into a Cartesian Coordinate System (CCS) comprising an X axis, a Y axis, and a Z axis, wherein three perpendicular planes exist, the three perpendicular planes being XY, YZ and XZ, and the three perpendicular planes intersecting at an origin point; the club head comprising a body, a hosel, a crown having a crown surface, a sole and a face;

orienting a hosel axis line of the club head in the YZ plane passing through the origin point;

orienting the hosel axis line of the club head so that it lies at a 60 degree angle measured from the −Y axis;

pivoting the club head around the hosel axis line until a toe point and a heel point have the same distance to the YZ plane;

viewing the club head along the X axis and projecting a crown silhouette curve and a sole silhouette curve onto a measurement plane which is parallel to the YZ plane;

placing a circle on the measurement plane between the projected crown silhouette curve and the projected sole silhouette curve;

enlarging the circle until the circle has a maximum diameter within the projected crown and sole silhouette curves;

creating a tangent line from a tangent point where the circle touches the projected crown silhouette curve to a tangent point where the circle touches the projected sole silhouette;

projecting the tangent line parallel along the X axis;

deriving 2D intersection curves of the club head along the tangent line projection; and positioning a rectangle approximately 0.030 inch above, in the +Z direction and 0.800 inch to the right, in the +X direction, of an endpoint of intersection of the face and the crown, the rectangle having a preferred height of 0.25 inch and a preferred length of 1.00 inch, the rectangle defining a crown apex zone, wherein the highest point of the crown surface is located within the crown apex zone, wherein the toe and heel points are located approximately one inch on either side of a face center point.

2. The method according to claim 1 wherein the driver type golf club head has a volume of more than 400 cubic centimeters.

3. The method according to claim 1 wherein the body is composed of a stainless steel material.

4. The method according to claim 1 wherein the sole is composed of a metal material and the crown is composed of a nonmetal material.

5. The method according to claim 1 wherein the body is composed of a titanium alloy material.

6. A method for forming a driver type golf club head comprising a face and a crown having a crown surface, the method comprising:

orienting the golf club head in a Cartesian coordinate system using a largest tangent circle method; and positioning a rectangle approximately 0.030 inch above, in a +Z direction, and 0.800 inch to the right of, in a +X direction, an endpoint of an upper end of an intersection curve of the face, wherein the rectangle has a preferred height of 0.25 inch and a preferred length of 1.00 inch, wherein the rectangle defines a crown apex zone, and wherein the highest point of the crown surface is located within the crown apex zone.

* * * * *